US008967503B2

(12) United States Patent
Schmandra et al.

(10) Patent No.: US 8,967,503 B2
(45) Date of Patent: Mar. 3, 2015

(54) METHOD AND DEVICE FOR COMMINUTING REFRIGERATOR APPLIANCES

(75) Inventors: Angelo Schmandra, Immenstadt (DE); Christopher Dreschsel, Sonthofen (DE)

(73) Assignee: BHS-Sonthofen GmbH, Sonthofen (DE)

( * ) Notice: Subject to any disclaimer, the term of this patent is extended or adjusted under 35 U.S.C. 154(b) by 179 days.

(21) Appl. No.: 13/806,307

(22) PCT Filed: Jun. 24, 2011

(86) PCT No.: PCT/EP2011/060642

§ 371 (c)(1),
(2), (4) Date: Dec. 21, 2012

(87) PCT Pub. No.: WO2011/161252

PCT Pub. Date: Dec. 29, 2011

(65) Prior Publication Data

US 2013/0233949 A1 Sep. 12, 2013

(30) Foreign Application Priority Data

Jun. 25, 2010 (DE) ..... 10 2010 030 544

(51) Int. Cl.
*B02C 23/34* (2006.01)
*B02C 19/00* (2006.01)
*B02C 23/26* (2006.01)

(52) U.S. Cl.
CPC ..... *B02C 19/0056* (2013.01); *B02C 23/26* (2013.01)
USPC ..... 241/18; 241/31; 241/48; 241/57

(58) Field of Classification Search
USPC ..... 241/18, 19, 60, 48, 30, 34, 31, 57
See application file for complete search history.

(56) References Cited

FOREIGN PATENT DOCUMENTS

| | | | | |
|---|---|---|---|---|
| DE | 3911596 | A1 | * | 11/1990 |
| DE | 10105995 | B4 | * | 4/2006 |
| DE | 10228471 | B4 | * | 10/2008 |
| EP | 0 287 935 | A2 | | 4/1988 |
| EP | 0442113 | A3 | * | 1/1992 |
| EP | 0 606 891 | A1 | | 1/1994 |
| EP | 1 215 023 | A1 | | 6/2002 |
| EP | 1 442 000 | A1 | | 5/2004 |

* cited by examiner

*Primary Examiner* — Mark Rosenbaum
(74) *Attorney, Agent, or Firm* — Rothwell, Figg, Ernst & Manbeck, P.C.

(57) ABSTRACT

The invention relates to a method for comminuting refrigeration appliances (12), in which the refrigeration appliances (12) are introduced into the comminution chamber (16) through a supply opening (14) of a comminution chamber (16), are continuously comminuted in the comminution chamber (16), and comminuted refrigeration appliance material (24) is discharged from the comminution chamber (16) through a discharge opening (26) of the comminution chamber (16), the comminution chamber (16) is flushed with air in that, per time unit, a predetermined volume ($L_1$) of the air which is present in the comminution chamber (16) and which is enriched with process gases which occur during comminution of the refrigeration appliances (12) is supplied to the gas processing means (34) through a gas conveying line (32) which is connected in a gas conveying manner to the discharge opening (26) and a gas processing means (34), and a volume of air ($L_4$) corresponding to that predetermined volume ($L_1$) is supplied to the comminution chamber (16) through the supply opening (14).

12 Claims, 1 Drawing Sheet

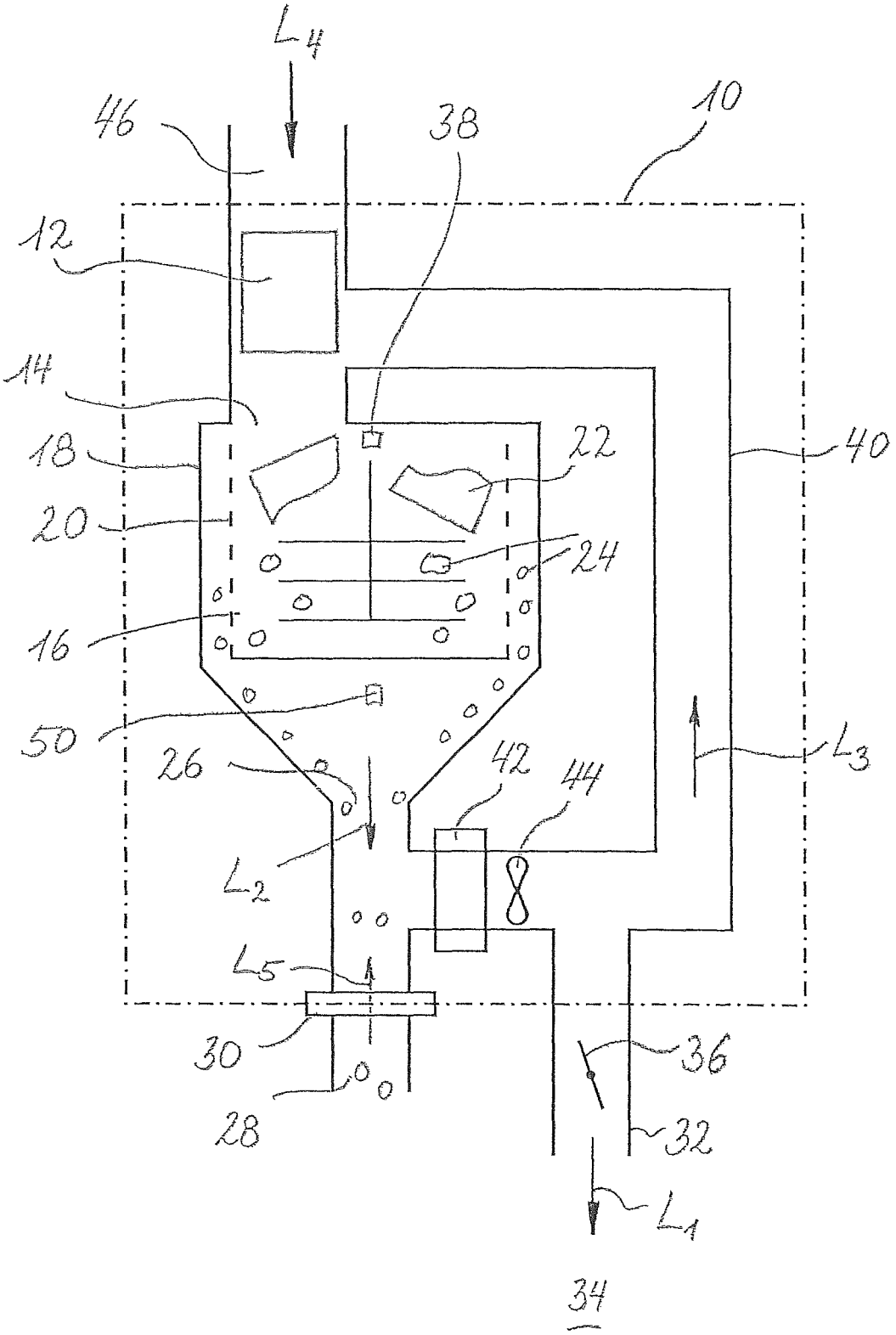
L4
46
38
10
12
14
18
22
40
20
24
16
50
26
42
44
L3
L2
L5
30
36
28
32
L1
34

METHOD AND DEVICE FOR COMMINUTING REFRIGERATOR APPLIANCES

CROSS REFERENCE TO RELATED APPLICATION

This application is a 35 U.S.C. 371 National Phase Entry Application from PCT/EP2011/060642, filed Jun. 24, 2011, which claims the benefit of German Patent Application No. 10 2010 030 544.8 filed on Jun. 25, 2010, the disclosure of which is incorporated herein in its entirety by reference.

The invention relates to a method for comminuting refrigeration appliances.

The process gases which are released when comminuting refrigeration appliances, for example, refrigerators, chest freezers and the like, constitute an important peripheral condition for the comminution method.

Previously, in order to expand the insulation foams in the outer walls of refrigeration appliances, chlorofluorocarbon (CFC) was used, which is known to damage the ozone layer. Therefore, a release of CFC when comminuting refrigeration appliances cannot be tolerated. Consequently, refrigeration appliances must be comminuted in closed devices. CFC was subsequently replaced by less harmful hydrocarbons, for example, cyclopentane, isobutane or the like. In order to simplify the terminology, the present invention will be explained below with reference to the example of cyclopentane, abbreviated to pentane.

However, these hydrocarbons mostly have the disadvantage of being explosive in air above a predetermined concentration. Pentane, for example, is explosive at a concentration of more than 40 g per cubic meter of air. Since both older CFC refrigeration appliances and newer pentane refrigeration appliances have to be comminuted in the same device for economic reasons, the risk of explosion associated with an enrichment of pentane in the closed space presents a problem.

In a known method, a discontinuous process is used. A predetermined number of refrigeration appliances is introduced into a comminution chamber. The comminution chamber is subsequently closed in order to be able to prevent a discharge of the CFC process gas released during the comminution of older refrigeration appliances. Furthermore, the comminution chamber is flushed with nitrogen gas in order to prevent the explosion risk of the process gas pentane released during the comminution of newer refrigeration appliances. The comminution device is now operated for a predetermined period of time which is sufficient to comminute the refrigeration appliances to the desired extent. Finally, the comminuted refrigeration appliance material is discharged from the comminution chamber and the process can begin again with a new batch of refrigeration appliances.

This batch comminution method in which nitrogen is rendered inert has the disadvantage of high operating costs. This is due, on the one hand, to the discontinuous batch operation and, on the other hand, to the costs for the provision of the nitrogen gas required for the inerting.

An object of the present invention is therefore to provide a more economical method for comminuting refrigeration appliances.

This object is achieved according to the invention by a method for comminuting refrigeration appliances, in which the refrigeration appliances are introduced into the comminution chamber through a supply opening of a comminution chamber, are continuously comminuted in the comminution chamber, and comminuted refrigeration appliance material is discharged from the comminution chamber through a discharge opening of the comminution chamber, the comminution chamber is flushed with air in that, per time unit, a predetermined volume of the air which is present in the comminution chamber and which is enriched with process gases which occur during comminution of the refrigeration appliances is supplied to the gas processing means through a gas conveying line which is connected in a gas conveying manner to the discharge opening and a gas processing means, and a volume of air corresponding to that predetermined volume is supplied to the comminution chamber through the supply opening.

A significant finding of the method according to the invention is that, in order to prevent the explosion risk brought about by the process gas pentane, it is not absolutely necessary to render the atmosphere in the comminution chamber inert, but instead it is also possible to flush the comminution chamber with normal air. Since the quantity of air required for this can be readily drawn in through the supply opening of the comminution chamber, the comminution method also does not have to be carried out in a batch operation, but can be carried out continuously. On the one hand, the omission of the requirement to provide a specific inerting gas, for example, nitrogen and, on the other hand, the configuration of the comminution method according to the invention as a continuous method increase the efficiency and consequently the cost-effectiveness of the method according to the invention.

In a development of the invention, it is proposed that, of the entire volume of air being discharged from the discharge opening, only a predetermined fraction is supplied to the gas processing means, whilst the remainder of the air which is discharged from the comminution chamber through the discharge opening and which is enriched with process gases which occur during comminution of the refrigeration appliances is returned to the comminution chamber through an additional gas conveying line which is connected in a gas conveying manner both to the discharge opening and to the supply opening.

This return of air has the following advantage: there are comminution devices, for example, the BHS rotor shredder, which, owing to their construction, act as a fan which draws in air through the supply opening and expels it again from the discharge opening. The construction and function of the BHS rotor shredder are described, for example, in DE 2004 024 331 A1 whose disclosure in this regard is hereby incorporated in the disclosure of the present application. As will be further set out in the embodiment which is to be explained below, the air throughput brought about by this fan effect is greater than the volume of air which must be supplied to the gas processing means per time unit in order to ensure that the concentration of pentane in the comminution chamber does not exceed the explosion-critical value. The provision of a return line therefore has the advantage that a controlled flow path can be provided for the excess volume of air.

In order to be able to remove dust from the comminuted refrigeration appliance material discharged from the comminution chamber and/or at least to be able to reduce the risk of a possible dust explosion in the comminution chamber, it is proposed that at least a portion of the volume of air being discharged from the discharge opening, preferably the entire volume of air being discharged from the discharge opening, be supplied to a dust filter.

A fan may further be provided in a gas conveying line which at least partially conveys the volume of air being discharged from the discharge opening. Using such a fan, it is possible, for example, to compensate for a pressure drop which occurs over the dust filter. However, it is also possible to use the fan only for the adjustment of the returned quantity of air. The fan and/or the dust filter may, for example, be arranged in the return line.

In order to be able to further reduce the risk of uncontrolled discharge of the process gases which occur during the comminution of refrigeration appliances, in particular CFC and pentane, from the comminution chamber and the gas conveying lines which are connected thereto, in a development it is further proposed that the pressure prevailing in the comminution chamber and the gas conveying lines which are connected thereto be kept to a value which is lower than the value of the ambient pressure. Owing to this measure, no air which is enriched with process gases is able to escape from the comminution chamber and the gas conveying lines owing to any leaks which may be present. Instead, air is at most drawn into the comminution chamber from the external environment owing to these leaks. This also applies to system-related leaks, for example, the material discharge for comminuted refrigeration appliance material which is adjacent to the discharge opening. Although sluice systems are used in this instance, for example, a cellular wheel sluice, they are never completely airtight, but instead always lead to an unavoidable intake of air. However, the volume of air thereby drawn in per time unit is negligible in comparison with the volume drawn in through the supply opening in order to flush the comminution chamber and can be considered to be a leak in the context of the explanation of the basic concept of the present invention.

In this context, it should be noted that the pressure ratios in the comminution chamber and the gas conveying lines connected thereto are anything but homogeneous owing to the comminution operation. The reduced pressure condition set out above therefore applies to the pressure value averaged over the volume of the comminution chamber.

In order to further increase the operational safety, it is proposed that the concentration of process gases in the comminution chamber be monitored. In this instance, if the concentration of the process gases in the comminution chamber exceeds a predetermined threshold value, the number of refrigeration appliances supplied to the comminution chamber per time unit can be reduced.

In principle, it is conceivable that, in order to flush the comminution chamber, fresh air is drawn exclusively from the environment. However, since in an installation for the comminution of refrigeration appliances there are generally also other locations at which the release of process gas into the ambient air must be prevented, in a development of the invention it is proposed that the quantity of air supplied to the comminution chamber for flushing is drawn in at least partially at these locations and is supplied to the comminution chamber.

As already mentioned above, it is possible to use for the continuous comminution of the refrigeration appliances, for example, a BHS rotor shredder. Impact crushers are generally particularly suitable for continuous comminution of the refrigeration appliances. Such impact crushers are generally operated at high speed so that the comminution elements thereof have sufficient momentum on contact with a refrigerator or refrigerator fragment to be able to comminute it. Owing to the high speed, these impact crushers produce a high air throughput from the supply opening to the discharge opening. In the BHS rotor shredder, this air throughput is stirred, for example, in such a manner that, owing to the centrifugal effect of the comminution elements, the air is forced radially outwards together with the comminuted refrigeration appliance material through a grid which is provided in the peripheral wall of the comminution chamber and from there flows downwards towards the discharge opening.

As is generally conventional, in the refrigeration appliance comminution method according to the invention predetermined components may also be removed from the refrigeration appliances before they are introduced through the supply opening into the comminution chamber. The predetermined components may, for example, be glass, mercury switches, capacitors, cables, refrigerants and oil, the compressor and the door seals.

From another viewpoint, the invention further relates to a device for continuous comminution of refrigeration appliances, comprising a comminution chamber having a supply opening through which the refrigeration appliances are introduced into the comminution chamber, and a discharge opening, through which comminuted refrigeration appliance material is discharged from the comminution chamber, and a gas conveying line which is connected in a gas conveying manner to the discharge opening and a gas processing means and by means of which, per time unit, a predetermined volume of the air which is present in the comminution chamber and which is enriched with process gases which occur during comminution of the refrigeration appliances is supplied to the gas processing means.

With regard to the advantages which can be achieved with this device and also with regard to the other configuration possibilities of this device, reference should be made to the above description of the comminution method according to the invention. These other configuration possibilities may, for example, be:

- providing another gas conveying line which is connected in a gas conveying manner to both the discharge opening and the supply opening,
- providing a dust filter,
- providing a fan,
- providing a sensor for detecting the pentane concentration in the air present in the comminution chamber,
- providing a pressure sensor in the comminution chamber, to name but a few.

It should be added that the gas processing means may, for example, be a combustion installation, the thermal energy released during the combustion being able to be used, for example, to produce electrical current, district heating or the like. Alternatively, however, it is also conceivable for the process gases in the gas processing means to be chemically decomposed.

The invention is explained in greater detail below with reference to an embodiment and the single drawing, FIG. 1, which is a rough schematic illustration of the construction of a device for comminuting refrigeration appliances.

In FIG. 1, a device for continuous comminution of refrigeration appliances 12 is generally designated with reference numeral 10. In a pre-disassembly station (not shown), predetermined components, for example, glass, mercury switches, capacitors, cables, refrigerants and oil, the compressor and the door seals, are removed from the refrigeration appliances before they are introduced via a supply opening 14 into the comminution chamber 16 of a comminution appliance 18.

The comminution appliance 18 may be an impact crusher, for example, a BHS rotor shredder as described in DE 2004 024 331 A1. This BHS rotor shredder 18 has a vertical, rotary-driven shaft 18*a*, to which a plurality of comminution elements 18*b* is movably connected on all sides. A peripheral wall of the comminution chamber 16 of the BHS rotor shredder is at least partially constructed as a grid 20. In the comminution chamber 16, the comminution elements 18*b* act on the refrigeration appliances 12 or refrigeration appliance fragments 22 until the comminuted refrigeration appliance material 24 has reached a size which enables it to pass through the grid 20 and to reach the discharge opening 26.

During comminution of the refrigeration appliances 12, in particular during comminution of the insulation foams of the outer walls of the refrigeration appliances 12, process gases are unavoidably released. Of particular significance in this instance are the chlorofluorocarbons (CFCs) used in older refrigeration appliances to foam the insulation material and the pentane which is used as a replacement in newer refrigeration appliances. Owing to the environmental impact thereof, CFC must not reach the external environment in an uncontrolled manner. It should further be ensured that the concentration of pentane in the comminution chamber 16 does not rise so significantly that explosions may occur. The danger of an explosion of the pentane/air admixture exists from a concentration of 40 g of pentane per cubic meter of air.

In order to be able to prevent the uncontrolled discharge of CFC, the device 10 is constructed so as to be closed at the discharge side. In particular, the material outlet 28 through which the comminuted refrigeration appliance material 24 leaves the comminution device 10 is constructed with a sluice device 30, for example, a cellular wheel sluice. In order to be able to prevent an excessively high enrichment of pentane in the comminution chamber 16, a predetermined volume of air enriched with process gas is conveyed per time unit through a gas conveying line 32 which is connected to the discharge opening 26 from the comminution chamber 16 to a gas processing means 34 (not shown in greater detail). The air throughput $L_1$ through the line 32 may, for example, be 5000 $m^3$/h, i.e. substantially more than 1 $m^3$/s. The value of the air throughput $L_1$ may be adjustable, for example, by means of a fan or, as shown schematically, by means of a flow delimitation member 36.

In the present example, in which the comminution chamber has a volume of approximately 20 $m^3$, the value of the pentane concentration in the pentane/air admixture of the comminution chamber can be retained by the extraction of the quantity of air $L_1$ below a predetermined threshold value, for example, below 10 g/$m^3$, i.e. approximately 25% of the explosion-critical value. Compliance with this threshold value may be monitored, for example, by means of a sensor 38.

The threshold value mentioned above is even complied with if it is assumed that the comminution chamber 16 is charged exclusively with pentane refrigeration appliances 12, one refrigeration appliance with a pentane quantity of 250 g is introduced into the comminution chamber 16 per minute, and this quantity of pentane in the comminution chamber 16 is completely released during the first 10 to 15 seconds of comminution. If it is considered that a significant portion of the pentane remains bound in the insulation material and is removed therefrom only in additional processing steps, and if it is further taken into consideration that not every refrigeration appliance 12 supplied to the comminution chamber 16 contains pentane, it can readily be seen that it is also possible to comminute more than one refrigeration appliance 12 per minute.

In practice, it is, for example, possible to supply the value of the pentane concentration detected by the sensor 38 to a control unit (not shown) which controls the conveying speed of a transport device in order to supply the refrigeration appliance 12 into the comminution chamber 16. If the value of the pentane concentration increases, the control unit can reduce the conveying speed and consequently reduce the number of refrigeration appliances supplied per time unit. If the value of the pentane concentration decreases, on the other hand, the control unit can increase the conveying speed and consequently the number of refrigeration appliances supplied per time unit.

As already mentioned above, the BHS rotor shredder 18 acts as a fan which draws in air through the supply opening 14 and expels it again through the discharge opening 26. In the present example, the air throughput $L_2$ may be approximately 24000 $m^3$/h, that is to say, around 5 times the air throughput which must be extracted from the comminution chamber 16 in order to keep the pentane concentration in the pentane/air admixture of the comminution chamber at a safe value.

With regard to the differing values of the air throughputs $L_1$ and $L_2$, it is possible, in order to be able to ensure a controlled flow of air in the comminution device 10, to preferably provide a return line 40 which conveys the excess air $L_3$ expelled from the discharge opening 26 back to the supply opening 14.

As mentioned above, the air discharge from the comminution device 10 through the line 32 may be, for example, 5000 $m^3$/h. This quantity of air is drawn in, with the exception of leaks, exclusively via the supply opening 14 ($L_4$=$L_1$). In particular, the quantity of air $L_5$ which can enter through the sluice device 30 into the comminution device 10 is very much lower than this value and can be considered to be a leak in the context of the explanation of the present invention.

With regard to the fact that the flow of air $L_4$ drawn in is approximately 5000 $m^3$/h, it can readily be seen that no sluice device needs to be provided at the supply side, but instead that it is sufficient to select the cross-section of the inlet opening 46 to be as small as possible, taking into account the dimensions of the largest refrigeration appliances 12 to be comminuted. In addition, at least a portion of the air flow $L_4$ drawn in from locations (not shown) of the entire installation can be supplied for recycling of refrigeration appliances at which there is also the risk of process gases being released, for example, a device in which the comminuted insulation foams with the foaming gas still contained therein are compressed to form pellets, the foaming gas being pressed out of the pores of the foams.

In order to be able to remove dust from the comminuted refrigeration appliance material discharged from the comminution chamber 16 and/or in order to reduce the dust concentration in the air circulating in the return line 40 and consequently to be able to reduce the risk of a dust explosion, a dust filter 42 may be arranged in the return line 40, preferably upstream of the branch of the line 32 which leads to the gas processing means 34. If the pressure drop over the dust filter 32 is too great, a fan 44 may additionally be provided in the return line 40.

It should be added that a pressure sensor 50 may further be arranged in the comminution chamber 16 in order, by means of appropriate control, for example, of the fan 44 and/or the flow delimitation member 36, to be able to ensure that the pressure prevailing in the comminution chamber is lower than the pressure in the external environment of the comminution device 10.

Finally, it should be noted that the concept according to the invention is not restricted to the use of high-speed comminution appliances, for example, impact crushers, but can also be used in conjunction with low-speed comminution appliances, for example, cutting comminution appliances.

The invention claimed is:

1. A method for comminuting refrigeration appliances (12), wherein:

the refrigeration appliances (12) are introduced into the comminution chamber (16) through a supply opening (14) of a comminution chamber (16), are continuously comminuted in the comminution chamber (16), and comminuted refrigeration appliance material (24) is discharged from the comminution chamber (16) through a discharge opening (26) of the comminution chamber (16), the comminution chamber (16) is flushed with air in that, per time unit, a predetermined volume ($L_1$) of the air which is present in the comminution chamber (16) and which is enriched with process gases which occur during comminution of the refrigeration appliances (12) is supplied to a gas processing means (34) through a gas conveying line (32) which is connected in a gas conveying manner to the discharge opening (26) and a gas processing means (34), and a volume of air ($L_4$) corresponding to that predetermined volume ($L_1$) is supplied to the comminution chamber (16) through the supply opening (14), wherein the volume of air ($L_4$) corresponding to the predetermined volume ($L_1$) is continuously supplied to the comminution chamber (16) through the supply opening (14), and the predetermined volume ($L_1$) is adjusted in such a manner that, in spite of continuous air supply through the supply opening (14), a pressure prevailing in the comminution chamber (16) and in the gas conveying lines (32, 40) which are connected thereto is kept to a value which is lower than the value of the ambient pressure.

2. The method according to claim 1, wherein, of the entire volume of air ($L_2$) being discharged from the discharge opening (26), only a predetermined fraction is supplied to the gas processing means (34), whilst the remainder of the air which is discharged from the comminution chamber (16) through the discharge opening (26) and which is enriched with process gases which occur during comminution of the refrigeration appliances (12) is returned to the comminution chamber (16) through an additional gas conveying line (40) which is connected in a gas conveying manner both to the discharge opening (26) and to the supply opening (14).

3. The method according to claim 1, wherein at least a portion of the volume of air ($L_2$), being discharged from the discharge opening (26), is supplied to a dust filter (42).

4. The method according claim 1, wherein a fan (44) is provided in the gas conveying line (40) which at least partially conveys the volume of air ($L_2$) being discharged from the discharge opening (26).

5. The method according to claim 1, wherein the concentration of process gases in the comminution chamber (16) is monitored.

6. The method according to claim 5, wherein if the concentration of process gases in the comminution chamber (16) exceeds a predetermined threshold value, the number of refrigeration appliances (12) supplied to the comminution chamber (16) per time unit is reduced.

7. The method according claim 1, wherein the quantity of air ($L_4$) supplied to the comminution chamber (16) through the supply opening (14) is at least partially supplied from locations of an installation for comminuting refrigeration appliances (12) at which process gas is also released.

8. The method according to claim 1, wherein for continuous comminution of the refrigeration appliances (12), an impact crusher (18) is used.

9. The method according to claim 8, wherein the impact crusher (18) is a rotor shredder.

10. The method according to claim 1, wherein predetermined components are removed from the refrigeration appliances (12) before they are introduced through the supply opening (14) into the comminution chamber (16).

11. The method according to claim 1, wherein the predetermined volume ($L_1$) is adjusted in such a manner that no explosion-critical concentration threshold value is reached and/or exceeded in the comminution chamber.

12. The method according to claim 1, wherein the entire volume of air ($L_2$), being discharged from the discharge opening (26), is supplied to a dust filter (42).

* * * * *